United States Patent [19]

Rich et al.

[11] 4,170,745

[45] Oct. 9, 1979

[54] LAMP FLASHING CIRCUIT FOR LINE GENERATING PHOTOEXPOSURE DEVICE

[75] Inventors: Leonard G. Rich, West Hartford; Henry F. Berdat, Manchester, both of Conn.

[73] Assignee: The Gerber Scientific Instrument Company, South Windsor, Conn.

[21] Appl. No.: 864,601

[22] Filed: Dec. 27, 1977

[51] Int. Cl.[2] ..... H05B 41/34

[52] U.S. Cl. ..... 315/241 R; 315/200 A; 315/307; 354/4

[58] Field of Search ..... 315/173, 200 A, 208, 315/209 R, 227 R, 241 R, 241 S, 241 P, 307; 354/4

[56] References Cited

U.S. PATENT DOCUMENTS

| | | | |
|---|---|---|---|
| 3,828,222 | 8/1974 | Mason | 315/241 R X |
| 4,007,399 | 2/1977 | White | 315/241 R |

*Primary Examiner*—Eugene R. LaRoche
*Attorney, Agent, or Firm*—McCormick, Paulding & Huber

[57] ABSTRACT

A circuit is disclosed for flashing a flash lamp in a photoexposure device which exposes lines on a photosensitive surface by projecting onto the surface a repetitive series of light spots the locus of which is moved relative to the surface so that the individual light spots partially overlap one another as a chain to synthesize the desired line. During each flash cycle, started by a cycle initiate pulse from an associated control circuit, conduction through the lamp is initiated by a high voltage pulse produced by the discharge of a triggering capacitor, through a high voltage pulse generating circuit, and conduction is thereafter continued by the discharge of a firing capacitor which supplies power at a lower voltage to the lamp. To optimize the maximum rate at which the lamp may be flashed the circuit operates, during each flash cycle, to trigger discharge of the capacitors immediately, or almost immediately, upon their reaching their desired charge. The flashing circuit also automatically compensates for changes in the voltage level at which the flash lamp extinguishes in each flash cycle, thereby maintaining the amount of light produced per flash relatively constant despite such changes.

11 Claims, 2 Drawing Figures

LAMP FLASHING CIRCUIT FOR LINE GENERATING PHOTOEXPOSURE DEVICE

BACKGROUND OF THE INVENTION

This invention relates to computer or otherwise automatically driven photoexposure devices for exposing lines and symbols on a photosensitive surface to produce artwork for printed circuits, photomasks and the like; and deals more particularly with a circuit for flashing the lamp of a photoexposure device of the type which generates lines by repetitively projecting light spots onto the surface at a relatively high rate while the locus of the spots is moved relative to the surface.

In photoexposure devices of the type with which this invention is concerned, that is, those which create lines by flashing spots of light, to obtain a high writing or line generating speed it is necessary, for high quality artwork, that the device be able to produce the spots at a high repetition or flash rate with excellent control over the amount of light contained in each flash.

The lamp used in the circuit of this invention is a Xenon lamp or a similar gas filled lamp. Such a lamp is commonly flashed by a circuit which includes a triggering capacitor and a firing capacitor. Discharging the triggering capacitor through an associated circuit produces a high voltage pulse across the lamp which ionizes a conducting path from its anode to its cathode. The main light producing conduction, energized by discharge of the firing capacitor, then follows this conducting path at a higher current and a lower voltage than that of the high voltage pulse which established the ionized path. Repeated firing of the lamp at high rates, however, gives rise to certain highly complex phenomena within the lamp. The net result of these is that the arc tends to have variable length in the lamp depending on the history of previous arc paths. The heated gases within the lamp tend to circulate providing nonuniform breakdown characteristics in the gas. In addition, impingement of ions or electrons at various portions of the internal metal electrodes tends to condition them to be better or poorer sources for the present discharge depending on past history. Because of these factors, the voltage at which the arc extinguishes may vary in accordance with the previous internal history of the lamp. Therefore, if the firing capacitor is charged to the same level during each flash cycle different amounts of light may be contained in different flashes due to the arc extinguishing at different voltages and thus having different durations.

The general object of this invention, is, accordingly, to provide an electronic circuit capable of flashing a flash lamp at a very high repetition or flash rate (flashes per second) and with a substantially constant output of light per flash.

A more particular object of the invention is to provide a lamp flashing circuit of the foregoing character wherein the rate of flashing is optimized by, among other things, initiating a discharge of the triggering and firing capacitors immediately, or within a few microseconds, of their reaching their desired charge voltages.

Another object of the invention is to provide a lamp flashing circuit of the foregoing character wherein uniform light output per flash is obtained by initiating the discharge of the triggering and firing capacitors by detecting the triggering capacitor voltage and initiating discharge when such voltage reaches a given reference value, whereby the voltage achieved by the firing capacitor during charging will depend on the voltage remaining thereon upon extinguishment of the arc in the previous cycle, thereby automatically compensating for changes in the voltage level at which arc extinguishment occurs.

Other objects and advantages of the invention will be apparent from the drawings and from the following description.

SUMMARY OF THE INVENTION

The invention resides in a lamp flashing circuit comprising, in addition to a gas filled flash lamp, a source of charging voltage, and a triggering capacitor and a firing capacitor, with associated discharge circuits for respectively establishing, by discharge of said capacitors, an ionized path through the lamp and thereafter producing a substantial period of light-emitting conduction through said path. A means operable in response to each of a series of flash cycle initiate pulses, from an associated control, connects charging circuits for the two capacitors to a source of charging voltage. A comparator then compares the triggering capacitor voltage with a reference voltage and operates, when comparison is reached, to disconnect the charging circuits from the charging voltage and to produce a signal supplied to a triggering capacitor to cause discharge of the triggering capacitor and consequent flashing of the lamp.

The invention further resides in the charging circuits for the two capacitors being resistance-capacitance circuits and in the RC time constants of the two circuits being substantially equal to one another. Further, the invention resides in the means for connecting and disconnecting the two charging circuits to and from the charging voltage being an electronic switching means, preferably two transistors each located in one of the charging circuits, and in the provision of a means inserting a delay between the detection of comparison of the triggering capacitor voltage with the reference voltage and the production of a trigger signal, to allow time for the junctions of the transistors to clear of carriers.

DESCRIPTION OF THE PREFERRED EMBODIMENT

Figure 1:
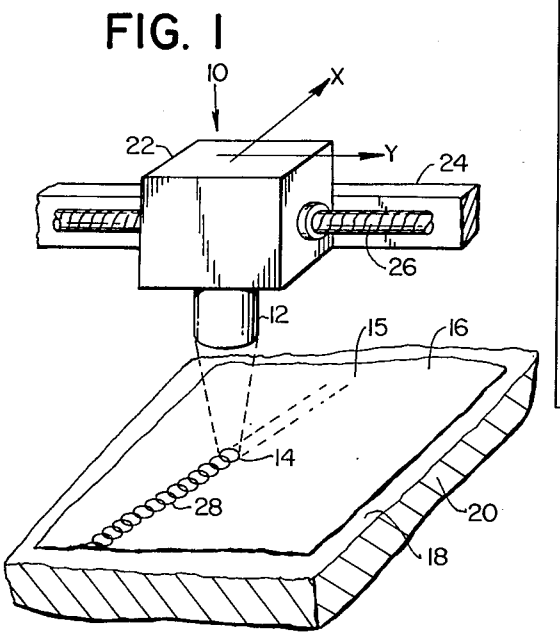
FIG. 1 is a fragmentary perspective view of a photoexposure device in which the lamp flashing circuit of this invention is used.

FIG. 1, by way of background, illustrates a photoexposure device, indicated generally at 10, of the type with which the lamp flashing circuit of this invention may be used. The device 10 includes a projector 12 which repetitively projects spots of light, such as the spot 14, usually circular, onto the surface 15 of a sheet of photosensitive material 16 carried by the supporting surface 18 of a table 20. The projector 12 is carried by a work carriage 22 movable in the indicated X and Y coordinate directions. The means for moving the carriage 22 may vary widely without departing from the invention and preferably includes a computer or other control for causing the movement to occur automatically. For example, the moving means may be taken to be similar to that shown in U.S. Pat. No. 3,330,182 with the carriage 22 being supported by an X carriage 24, movable in the X coordinate direction, and movable in the Y coordinate direction relative to the X carriage by a lead screw 26.

As the projector 12 projects its spots of light it is moved to move the locus of the projected spots relative to the surface 15 and to cause the individual spots to partially overlap one another in a chainwise fashion to generate an exposed line on the surface 15, as indicated at 28. The speed in inches per minute at which the line 28 can be generated depends, among other things, on the diameter of the spots, the number of flashes desired per aperture diameter and on the maximum rate at which the projector lamp is capable of being flashed.

In accordance with the invention, the projector 12 includes a flash lamp which is controlled and flashed by an associated circuit which operates to flash the lamp immediately upon associated triggering and firing capacitors reaching their desired levels of charge, so that at the maximum flashing rate, each flash cycle consists essentially only of the period of time required for charging the capacitors and the period of time required for discharging the capacitors through the lamp to create the flash.

Figure 2:
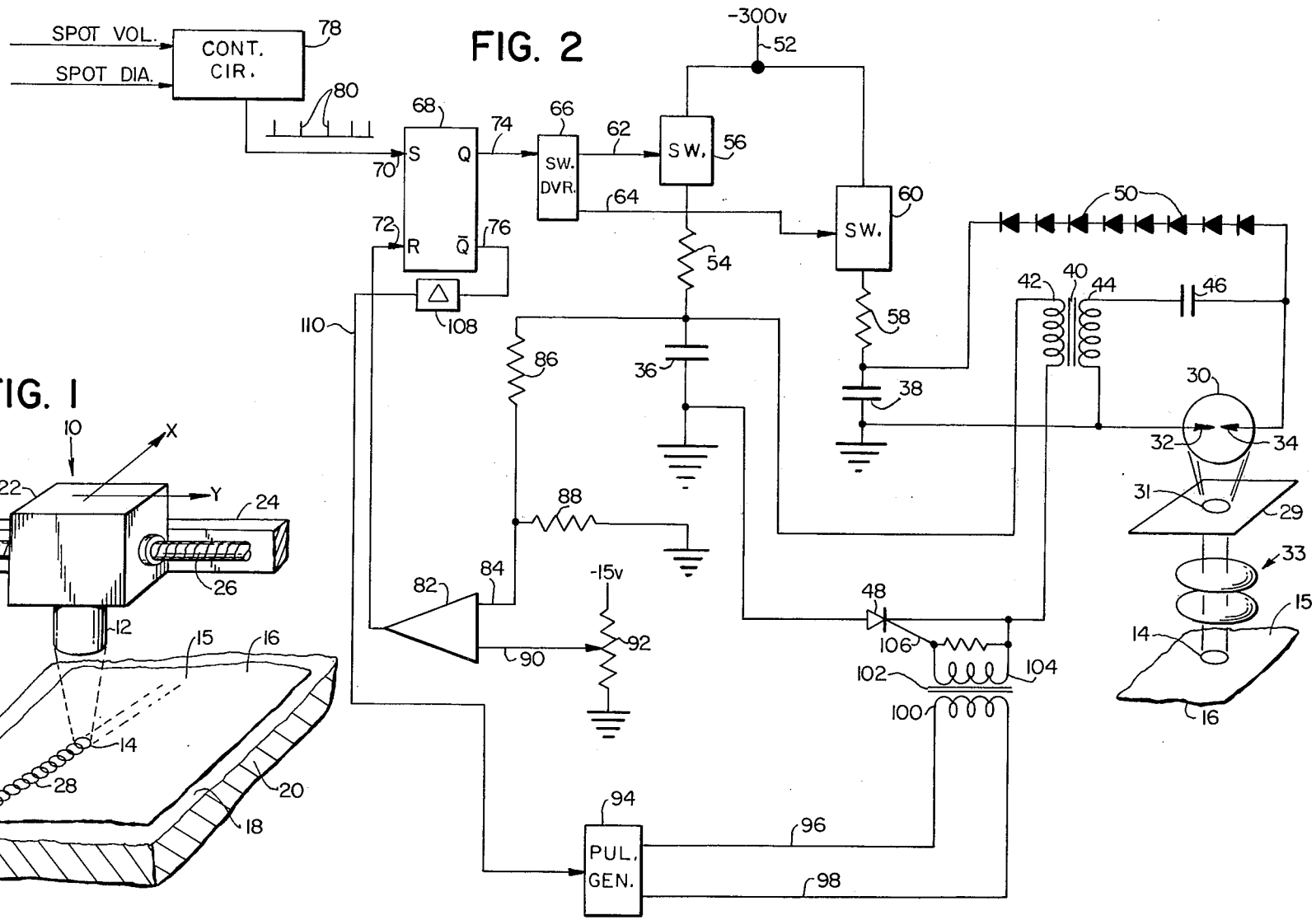
FIG. 2 is a schematic diagram illustrating a circuit embodying the invention and for flashing the lamp of the photoexposure device of FIG. 1.

The lamp flashing circuit comprising the invention is shown in FIG. 2. Turning to this figure, the flash lamp is indicated at 30 and is a gas filled lamp, such as a Xenon lamp, having an anode 32 and a cathode 34. One flash of the lamp 32 is produced by combined discharge of a triggering capacitor 36 and a firing capacitor 38. Light emitted by the lamp is directed to an aperture plate 29 having an aperture 31 determining the size and shape of the spot 14 projected onto the surface 15 by a projecting lens system indicated generally at 33.

The triggering capacitor 36 is connected to the lamp 30 by a discharge circuit including a step-up transformer 40 having a primary winding 42, connected in series with the triggering capacitor 36, and a secondary winding 44 connected across the lamp 30 in series with a blocking capacitor 46. A silicon controlled recitifer 48 in series with the primary winding 42 controls discharge of the triggering capacitor 36. The firing capacitor 38 is connected across the lamp 30 by a discharge circuit including a plurality of diodes 50, 50, connected in a series string as shown.

When the SCR 48 is triggered from its normally non-conducting to a conducting state the triggering capacitor 36 discharges through the primary winding 42 of the transformer 40, producing a high voltage output pulse from the secondary winding 44 which is applied across the lamp 30 to breakdown the gas within the tube and establish an ionized path between the anode 32 and cathode 34. During the appearance of the high voltage pulse, the diodes 50, 50 prevent the high voltage from being absorbed by the firing capacitor 38. The conduction through the lamp produced by this high voltage pulse is a high voltage low current conduction which by itself would be very short lived and produce very little light output. However, as soon as the ionized path is established the firing capacitor 38 discharges through the lamp 30 at a lower voltage and with a higher current to produce the major part of the flash.

In the circuit of FIG. 2, charging voltage for the capacitors 36 and 38 is taken from a source of −300 volts DC supplied on the line 52. One side of the triggering capacitor 36 is connected to ground and the other side is connected to the charging voltage line 52 through a resistor 54 and electronic switching device 56. Likewise, the firing capacitor 38 has one side connected to ground and has an associated charging circuit including a resistor 58 and electronic switching device 60 connected between its other terminal and the charging voltage line 52. The electronic switching devices 56 and 60 may take various different forms but preferably each is a transistor which is turned on and off in response to signals appearing on associated control lines 62 and 64, respectively.

The resistors 54 and 58 are preferably chosen so that the RC time constants of the charging circuits for their respective capacitors 36 and 38 are identical within the tolerance limits of the chosen components. The choice of the value of the triggering capacitor 36 is based on the energy required for breaking down or ionizing the gas in the lamp through the associated discharge circuit. The value of the firing capacitor is based on the illumination energy desired within the power capability of the lamp at the maximum flash repetition rate desired.

The switches 56 and 60 serve to connect and disconnect, at appropriate times, the two capacitors 36 and 38 to and from the charging voltage supply line 52 and are operated in unison with one another by a switch driving circuit 66 responsive to an output from a flip-flop 68. The flip-flop 68 is of the R-S latch type and has a set terminal 70, a reset terminal 72, a Q output terminal 74, and a $\overline{Q}$ output terminal 76.

A control circuit 78 supplies a repetitive series of flash cycle initiate pulses 80, 80 to the set terminal 70 of the flip-flop 68. As explained in more detail hereinafter, each pulse 80 dictates one flash of the lamp 60 and, therefore, the rate at which the pulses 80, 80 appear directly determines the flashing rate of the lamp 30. The control circuit 78 may vary widely without departing from the invention, but often it is desired that the flashing rate be varied in direct relation to the velocity of the spot locus relative to the photosensitive surface and in inverse relation to the diameter of the spots projected onto the surface. Therefore, in FIG. 2 the control circuit 78 is shown to be one having as inputs thereto a spot velocity signal, representing the velocity of the spot locus relative to the photosensitive surface, and a spot diameter signal, representing the diameter of the projected spots, and the circuit 78 is taken to be one which varies the repetition rate of the cycle initiate pulses 80, 80 in accordance with these input signals.

A comparator 82 has one input terminal 84 to which a fraction of the voltage appearing across the triggering capacitor 36 is supplied by a voltage divider comprised of resistors 86 and 88. The other comparator terminal 90 is supplied with a reference voltage from a potentiometer 92. The output of the comparator 82 is normally high and switches to a low value when the voltage at the terminal 84 reaches comparison with the voltage at the terminal 90.

The output terminal 76 of the flip-flop 68 is connected to a pulse generating circuit 94 which operates when the output at the terminal 76 switches from $\overline{Q}$ to Q, that is upon resetting of the flip-flop, to provide a current trigger pulse on its output lines 96 and 98 supplied to the primary winding 100 of an isolation transformer 102, the secondary winding 104 of which is connected across the trigger terminal 106 and cathode of the SCR 48. Therefore, upon occurrence of a pulse from the pulse generator 94 the SCR 48 is switched to its conducting state. Preferably, a time delay element 108 is included in the line 110 between the output terminal 76 of the flip-flop and the pulse generator 94 to provide a delay of a few microseconds between the time the output at the terminal 76 undergoes its transition from $\overline{Q}$ to Q and the time the trigger pulse is produced by the pulse generator 94.

Having now described the construction of the FIG. 2 flashing circuit its operation may be explained as follows. Prior to the beginning of each flash cycle, the triggering capacitor 36 is in a substantially fully discharged state and the electronic switches 56 and 60 in the charging circuits of the two capacitors 36 and 38 are non-conducting so as to disconnect the capacitors from the charging voltage supply line 52. The flip-flop 68 is also in its reset state. A cycle initiate pulse 80 is then supplied to the set terminal 70 of the flip-flop 68 by the control circuit 78. This sets the flip-flop 68 and switches the output appearing at the terminal 74. This in turn causes the switch driving circuit 66 to simultaneously turn on the switch elements 56 and 60 by signals supplied to these elements over the lines 62 and 64.

As soon as the switches 56 and 60 are turned on, the capacitors 36 and 38 take on charge from the supply line 52. During this charging process the voltage of the triggering capacitor 36 is monitored by the comparator 82 and when it reaches a given reference level, established by the potentiometer 92, a signal is supplied by the comparator 82 to the reset terminal 72 of the flip-flop 68 which resets the flip-flop. This resetting of the flip-flop simultaneously turns off the switches 56 and 60, through the switch driving circuit 66, to disconnect the capacitors 36 and 38 from the charging voltage. It also switches the signal appearing at the output terminal 76 of the flip-flop and this signal transition is supplied to the pulse generator 94 through the time delay element 108. The pulse generator 94, therefore, produces a trigger signal a few microseconds, as determined by the delay element 108, after the flip-flop 68 is reset, allowing time for the junctions of the switch elements 56 and 60 to clear of carriers and thereby assuring that the switches are fully turned off before the capacitors 36 and 38 are discharged.

The trigger signal produced by the pulse generator 94 triggers the SCR 48 on to discharge the triggering capacitor 36 through the primary winding 42 of the step-up transformer 40, thereby producing a high voltage pulse across the secondary winding 44. This high voltage pulse is applied across the lamp 30 and causes breakdown of the gas in the lamp to establish an ionized conduction path between its anode and cathode. As soon as the ionized path is established, the firing capacitor 36 discharges through the lamp to produce the principal light-emitting portion of the flash.

When the voltage across the lamp reaches a low value the arc extinguishes leaving a corresponding value of charge on the firing capacitor 38 at the beginning of the next flash cycle, and thereafter the next flash cycle is initiated by the appearance of the next flash cycle initiate signal 80 from the control circuit 78.

As mentioned previously, the voltage level at which the arc extinguishes during each flash cycle may vary depending on the past firing history of the lamp. The fact, however, that the charging and discharging of the capacitors is controlled in response to the charge on the triggering capacitor, thereby providing a constant charging time during each flash cycle, automatically compensates for changes in the arc extinguishing voltage. If during one flash cycle the arc extinguishes early a higher charge will be left on the firing capacitor 38, and if the arc extinguishes late a smaller charge will be left on the firing capacitor 38. This also means that the amount of light energy available from the particular flash under discussion will be lower for the arc which extinguishes early and greater for the arc which extinguishes late.

In the case of a flash which extinguishes early and leaves a little extra charge on the firing capacitor 38, thereby having produced a somewhat lower amount of light energy for that particular flash, the next flash will automatically be increased somewhat in duration, to increase the light output of that flash, because prior to the flash both capacitors will charge for the same amount of time as previously, allowing the voltage on the firing capacitor 38 to reach a slightly higher value than in the previous cycle, due to a higher starting voltage, with a consequent output of more light energy during the flash.

Similarly, in the case of a flash which is of long duration and leaves a little less than the usual charge on the firing capacitor 38, thereby having produced a somewhat greater amount of light energy for that particular flash, the next flash will have somewhat less light energy output, because the charging of the firing capacitor 38 will begin at a lower value but persist for the same amount of time as previously, the amount of time being determined by the charging of the trigger capacitor 36.

We claim:

1. A lamp flashing circuit for a photoexposure device operable to expose a line on a photosensitive surface by repeatedly projecting spots of light onto the surface as the locus of the spots is moved relative to the surface along the line to be exposed, said lamp flashing circuit comprising: a gas filled flash lamp with an anode and a cathode, a source of charging voltage, a firing capacitor, a discharge circuit including said flash lamp connected across said firing capacitor for discharging said firing capacitor through said lamp to create a flash when an ionized path exists between said anode and cathode, a triggering capacitor, a triggering circuit connected across said triggering capacitor and coupled with said flash lamp for discharging said triggering capacitor in response to a trigger pulse and for producing as a result of said discharge a high voltage pulse across said anode and cathode to create an ionized path therebetween and to thereby initiate the discharge of said firing capacitor, a charging circuit for said firing capacitor, a charging circuit for said triggering capacitor, a source of repetitive flash cycle initiate pulses, means operable in response to each of said flash cycle initiate pulses for simultaneously connecting said two charging circuits to said source of charging voltage, a comparator for comparing the voltage across said triggering capacitor with a given reference voltage, and means responsive to said comparator for simultaneously disconnecting said two charging circuits from said source of charging voltage and for producing a trigger pulse supplied to said triggering circuit to cause said discharging of said triggering capacitor when said voltage across said triggering capacitor reaches comparison with said given reference voltage.

2. A lamp flashing circuit as defined in claim 1 further characterized by said firing capacitor charging circuit comprising a first resistance in series with said firing capacitor between said source of charging voltage and ground, and said triggering capacitor charging circuit comprising a second resistance in series with said triggering capacitor between said source of charging voltage and ground.

3. A lamp flashing circuit as defined in claim 2 further characterized by the RC time constant of said firing capacitor charging circuit being substantially equal to the RC time constant of said triggering capacitor charging circuit.

4. A lamp flashing circuit as defined in claim 2 further characterized by said means for connecting said two charging circuits to said source of charging voltage and said means for disconnecting said two charging circuits from said source of charging voltage including an electronic switch means associated with said two charging circuits and said source of charging voltage, said electronic switch means having an on state in which said two charging circuits are electrically connected to said source of charging voltage and an off state in which said two charging circuits are electrically disconnected from said source of charging voltage.

5. A lamp flashing circuit as defined in claim 4 further characterized by said electronic switch means comprising a first electronic switch element in said firing capacitor charging circuit and a second electronic switch element in said triggering capacitor charging circuit.

6. A lamp flashing circuit as defined in claim 5 further characterized by each of said first and second electronic switch elements being a transistor.

7. A lamp flashing circuit as defined in claim 5 further characterized by said comparator being operable to produce a compare signal when said voltage across said triggering capacitor reaches said reference voltage, said means for connecting said two charging circuits to said source of charging voltage and said means for disconnecting said two charging circuits from said source of charging voltage also including a flip-flop having a set terminal to which said cycle initiate pulses are supplied so that said flip-flop is set by each of said cycle initiate pulses, said flip-flop also having a reset terminal to which said compare signal is supplied that said flip-flop is reset by each occurrence of said compare signal, said flip-flop having two output terminals at the first of which a Q signal appears and at the second of which a $\overline{Q}$ signal appears when said flip-flop is set and at the first of which a $\overline{Q}$ signal appears and at the second of which a Q signal appears when said flip-flop is reset, a switch driver connected between said first output terminal of said flip-flop and said electronic switch means for turning said electronic switch means on when said flip-flop is set and off when said flip-flop is reset, and means connected with said second output terminal of said flip-flop and to said triggering circuit for producing a trigger pulse supplied to said triggering circuit when said flip-flop is switched from its set to its reset state.

8. A lamp flashing circuit as defined in claim 7 further characterized by said triggering circuit including a step-up transformer having a primary winding connected across said triggering capacitor and a secondary winding connected across said anode and cathode of said flash lamp, a silicon controlled recitifer in series with said triggering capacitor and said primary winding for controlling the discharge of said triggering capacitor through said primary winding, and means connected with the trigger terminal of said silicon controlled rectifier for turning said silicon controlled rectifier on in response to the switching of said flip-flop from its set to its reset state.

9. A lamp flashing circuit as defined in claim 8 further characterized by said means connected to the trigger terminal of said silicon controlled rectifier including a pulse generator for creating a triggering pulse supplied to said silicon controlled rectifier triggering terminal in response to the voltage supplied to its input terminal switching from $\overline{Q}$ to Q, a line connecting said second output terminal of said flip-flop to said input terminal of said pulse generator, and a delay in said line for causing said pulse generator to create a triggering pulse at a time delayed from the time said flip-flop switches from its set to its reset state.

10. A lamp flashing circuit for a photoexposure device operable to expose a line on a photosensitive surface by repeatedly projecting spots of light onto the surface as the locus of the spots is moved relative to the surface along the line to be exposed, said lamp flashing circuit comprising: a flash lamp having an anode and a cathode, a triggering capacitor and a firing capacitor, a first discharge circuit connecting said triggering capacitor across said anode and cathode of said flash lamp, a trigger element in said first discharge circuit which trigger element is normally non-conducting to prevent discharge of said triggering capacitor through said first discharge circuit and it triggerable to a conducting state, said first discharge circuit being operable when said triggering capacitor is discharge therethrough to apply a high voltage pulse across said anode and cathode of said flash lamp to strike an ionized conduction path between said anode and cathode, a second discharge circuit associated with said firing capacitor for discharging said firing capacitor through said lamp between said anode and cathode in response to the creation of an ionized path between said anode and cathode, first and second charging circuits for said triggering and firing capacitors respectively, a source of direct current charging voltage, a source of flash cycle initiate signals, means responsive to each of said flash cycle initiates signals for connecting both of said first and second charging circuits to said source of charging voltage for a predetermined amount of charging time which predetermined amount of charging time is the same for each flash cycle, and means operable after the lapse of said predetermined amount of charging time for triggering said triggering element to discharge said triggering capacitor through said first discharge circuit.

11. A lamp flashing circuit for a photoexposure device operable to expose a line on a photosensitive surface by repeatedly projecting spots of light onto the surface as the locus of the spots is moved relative to the surface along the line to be exposed, said lamp flashing circuit comprising: a flash lamp, a triggering capacitor and a firing capacitor, a first discharge circuit connecting said triggering capacitor to said flash lamp, a trigger element in said first discharge circuit which trigger element is normally non-conducting to prevent discharge of said triggering capacitor through said first discharge circuit and is triggerable to a conducting state, said first discharge circuit being operable when said triggering capacitor is discharged therethrough to apply a high voltage pulse across said flash lamp to strike an ionized conduction path therethrough, a second discharge circuit associated with said firing capacitor for discharging said firing capacitor through said lamp in response to the creation of an ionized path therethrough, first and second charging circuits for said triggering and said firing capacitors respectively, a source of charging voltage, a source of flash cycle initiate signals, means responsive to each of said flash cycle initiate signals for connecting both of said first and second charging circuits to said source of charging voltage, and means operable when the voltage on said triggering capacitor reaches a predetermined value for disconnecting said two charging circuits from said source of charging voltage and for triggering said triggering element to discharge said triggering capacitor through said first discharge circuit.

* * * * *